United States Patent [19]

Maurits et al.

[11] 3,999,789

[45] Dec. 28, 1976

[54] LOCK

[75] Inventors: Orville C. Maurits; John H. Babb, Jr., both of Grand Rapids, Mich.

[73] Assignee: Kysor Industrial Corporation, Cadillac, Mich.

[22] Filed: Jan. 15, 1976

[21] Appl. No.: 649,245

[52] U.S. Cl. ..... 292/34; 70/107; 70/462; 292/35; 292/36

[51] Int. Cl.[2] ..... E05B 63/14

[58] Field of Search ..... 70/107–109, 70/462; 292/34–36, 40, 47–49, 138–140, 165, 167, 169, 184, 186, 231, 244, 245, DIG. 65

[56] References Cited

UNITED STATES PATENTS

| | | | |
|---|---|---|---|
| 579,388 | 3/1897 | Fleischmann | 70/107 |
| 1,944,470 | 1/1934 | Schlage | 70/146 |
| 3,017,760 | 1/1962 | Jones | 70/97 |
| 3,390,558 | 7/1968 | Tornoe et al. | 70/107 |
| 3,695,068 | 10/1972 | Eads et al. | 70/107 |
| 3,791,180 | 2/1974 | Doyle | 292/34 X |
| 3,910,613 | 10/1975 | Nolin | 70/462 X |

*Primary Examiner*—James T. McCall
*Assistant Examiner*—William E. Lyddane
*Attorney, Agent, or Firm*—Price, Heneveld, Huizenga & Cooper

[57] ABSTRACT

A lock of the type enabling panic exit, there being a unique drive arrangement from the inner knob to the latch bolt mechanism and the security dead bolt mechanism. This drive utilizes a vertically reciprocable slide at the inside of the door panel, biased in one direction, and shiftable in the other direction by rotation of the inner knob for retraction of both the latch bolt and the security dead bolt. The drive is not responsive to tampering with the spindle elements, e.g. after forced removal of the outside knob. The lock can be employed on either left or right-hand door arrangements, directly, without requiring handing.

6 Claims, 7 Drawing Figures

LOCK

BACKGROUND OF THE INVENTION

This invention relates to a lock having specially cooperative latch bolt and dead bolt mechanisms.

In recent years, the increased frequency of unauthorized entry has stimulated widespread usage of dead lock bolts arranged to supplement the customary latch bolt. In the simplest form of such an arrangement, the latch bolt and dead bolt are totally independent of each other. A separate inside turn operates the dead bolt, in addition to the inside knob or handle for the latch bolt. On the door exterior, an optional key actuator might be employed for the dead bolt, in addition to the outside knob actuator for the latch bolt. The outside knob may, if desired, also have a key lock. More recently, dead lock bolts of greater throw length are being substituted for the older shorter style, in efforts to frustrate improper entry through the technique of prying or otherwise damaging the door casing, as well as accommodating door frame warpage and the like.

These factors do offer a greater measure of security, but also involve greater complexity for those persons legitimately using the door, particularly under panic conditions. Hence, enlightened fire codes presently require installation of locks enabling both the latch bolt and the dead bolt to be rapidly retracted under panic conditions by operating just the inside knob. Presently marketed products achieve this by various ways of interconnecting the dead bolt mechanism with the latch bolt mechanism. Some of these products do in fact effect an excellent panic exit feature, but in doing so present other problems. One such problem involves "handing". Another significant problem involves tampering with the lock.

As to the feature of handing, a "handed" lock is one which can potentially be employed in a left-hand or a right-hand door arrangement by rearranging the interrelationship of some of the internal components of the lock. Presently, for those locks which cannot be so handed, two separate models must be manufactured and inventoried throughout the trade. There are locks on the market capable of handing. Unfortunately, although some can be handed by specially trained personnel in the field, the better known locks must be handed by trained personnel at the factory, or by a locksmith. And, since locks typically are installed by carpenters or other building tradesmen with no special locksmith training, even the partial disassembly and reassembly of the intricate components by such personnel to "hand" the lock results in a maximum of frustration, limited success, and added expense. The alternate choice of engaging a locksmith also adds considerable expense.

As to the tampering problem, the difficulty primarily arises with interconnection of the dead bolt mechanism to the latch bolt mechanism to provide the panic exit feature. This interconnection can enable the dead bolt to be thrown back by unauthorized tampering with the latch bolt mechanism particularly the spindle, from the outside. This can be done by forced removal of the outside knob with a hammer or other tool, and rotation of the exposed spindle with pliers or the like.

SUMMARY OF THE INVENTION

The lock of this invention effectuates the important panic exit feature with a unique assembly that is actually directly reversible for left or right-hand installations without requiring any handing. A tradesman or homeowner can readily install it.

The inventive lock can be readily installed by a building tradesman in either right-hand or left-hand arrangements. Four drilled holes in the door will accommodate the lock, there being no particular alignment or assembly difficulties. Cost savings result in installation simplicity and versatility. And, there are manufacturing cost advantages resulting from the simplicity of the lock components in their unique assembly.

The inventive lock effectuates tamper resistance from the exterior. Rotation of the spindle to the latch bolt does not operate the security dead bolt mechanism. Thus, forced removal of the outer knob for access is of no avail. A special cam drive and vertically reciprocable slide on the inside control the lock bolt mechanism. Only by disemboweling the lock and door can access be had from the exterior to components on the door interior that will operate the dead bolt.

The novel lock thus effects a simplified construction capable of panic exit, nontamper character, right or left-hand installation without requiring handing, and simplified installation. It employs, at the inside of the door, a unique vertically reciprocable slide and cam arrangement between the inner hand operator knob and the dead bolt mechanism. Action of the slide also operates the latch mechanism through a one way driver. A pivotal cam between the slide and the dead lock mechanism can move from either of two cocked positions to a neutral position during dead bolt retraction, for accommodating left-hand or right-hand installation. The inner knob, rotated in either direction, shifts the vertical slide in the same direction. This occurs whether the lock is on a left-hand or right-hand installation.

These and other features, objects, and advantages of this invention will be apparent from the following detailed description.

DESCRIPTION OF THE PREFERRED EMBODIMENTS

Figure 1:
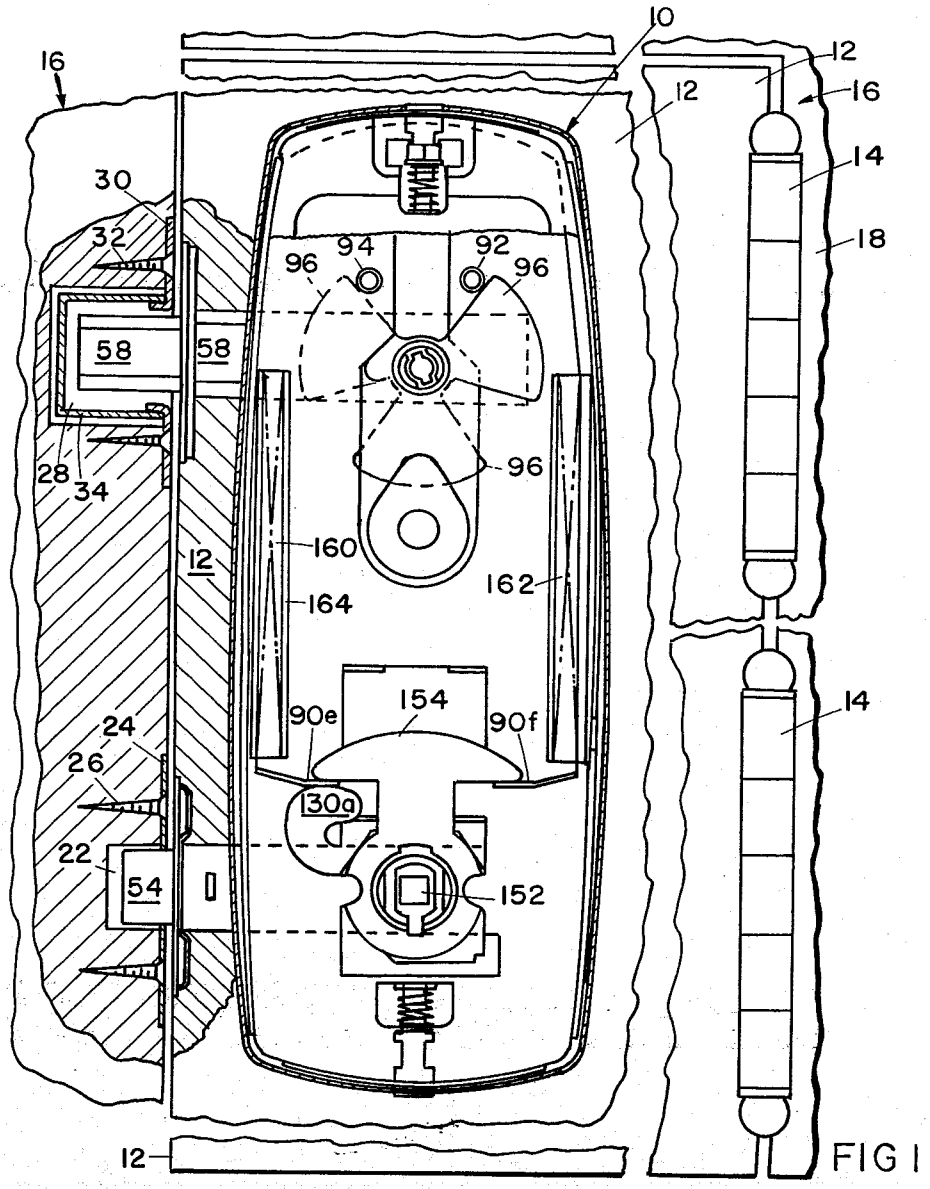
FIG. 1 is an elevational view, partially in section, of the novel lock assembly, shown in a left-hand door arrangement, with the latch bolt and the security dead bolt in extended positions.

Referring now specifically to the drawings, the lock assembly 10 is shown mounted to a door panel 12 shown in fragmentary portions, such door panel being supported by hinges 14 in typical fashion in a door frame 16 that includes a hinge post 18 and a latch post 20. In this illustrative embodiment, a left-hand door arrangement is set forth, i.e. with the hinges on the right as viewed from the inside. It will be understood that the lock is equally usable in a right-hand door arrangement.

Mounted at a recess 22 in door post 20 is a latch plate 24 as by screws 26, in conventional fashion. Plate 24 includes an opening to allow entry of a latch bolt into recess 22. Also mounted adjacent another recess 28, typically above recess 22, in door post 20, is a dead bolt plate 30, having a central opening corresponding with recess 28 for entry of a dead bolt in recess 28. It is held in position by screws 32 in typical fashion. Plate 30 preferably also has a box 34, as of metal or plastic, secured to the plate, and extending into recess 28, to assure minimum mortising requirement for extended projection of dead bolt, i.e. to assure proper recess depth for full extension of the dead bolt.

Figure 3:
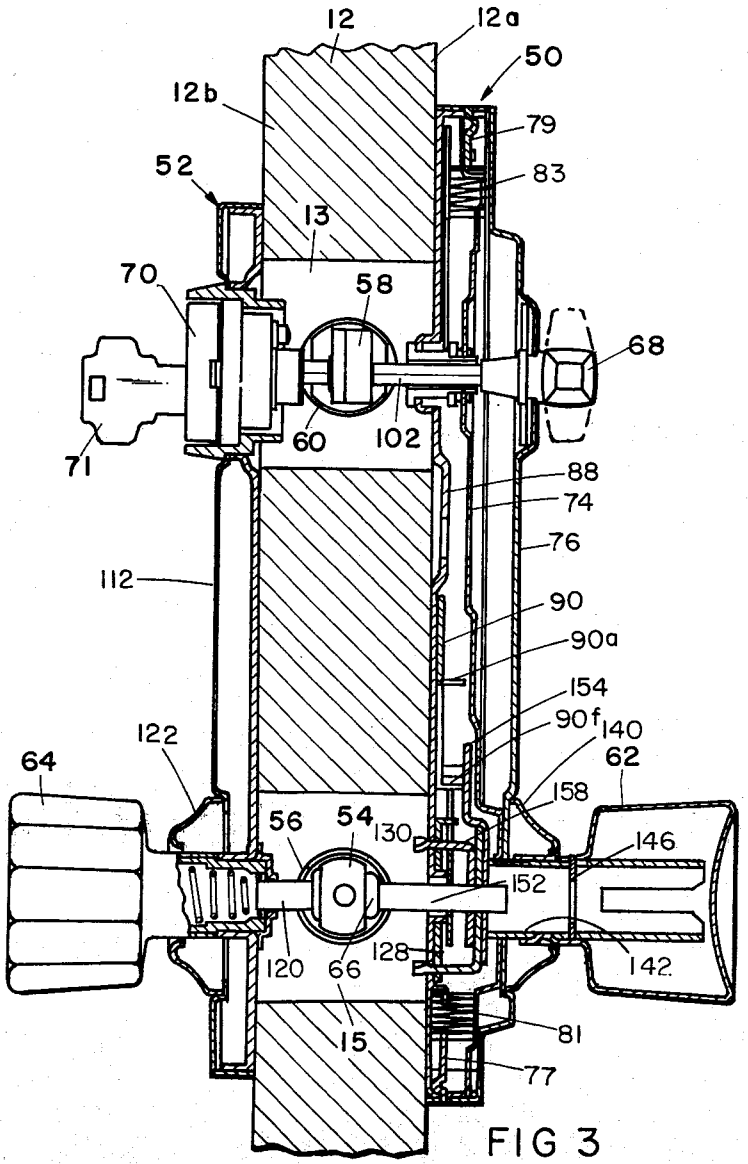
FIG. 3 is a sectional view of the door and lock assembly of FIGS. 1 and 2, edgewise of the door.
Figure 4D:
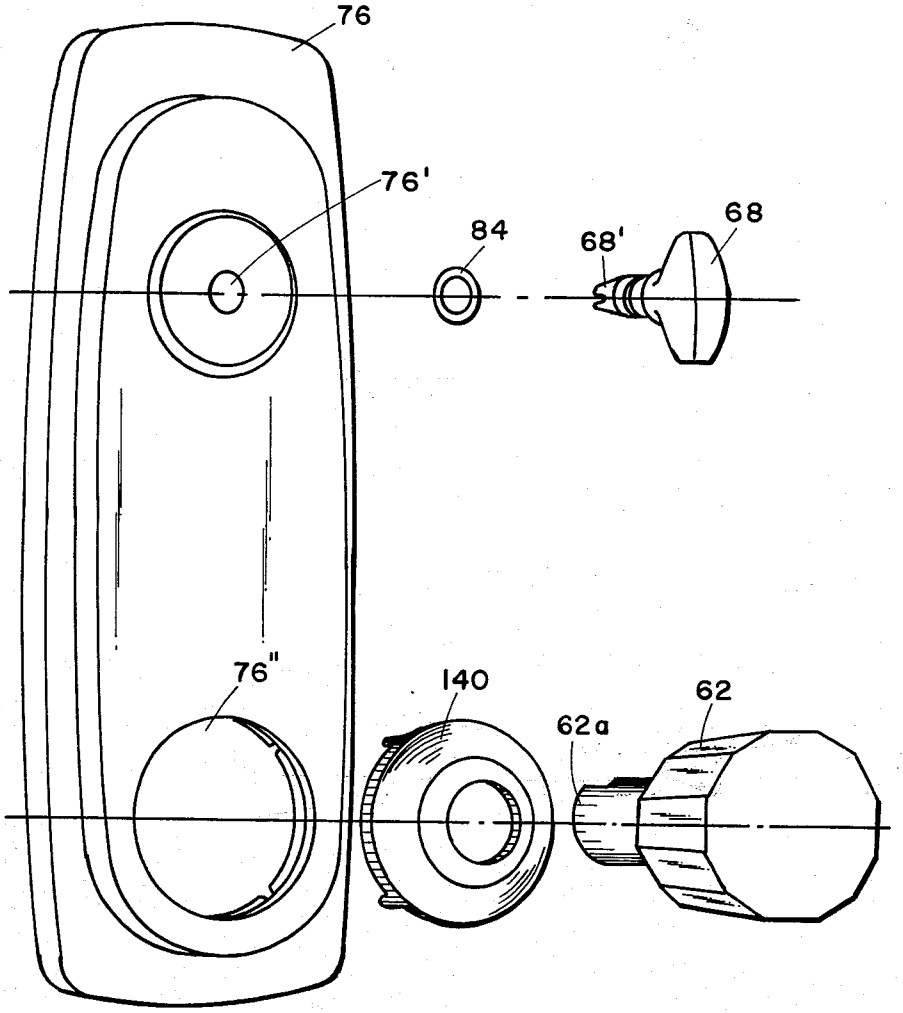
FIGS. 4A, 4B, 4C and 4D each constitute an exploded view of a portion of the lock in FIGS. 1, 2 and 3, and collectively constitute an exploded view of the entire lock assembly.
Figure 4A:
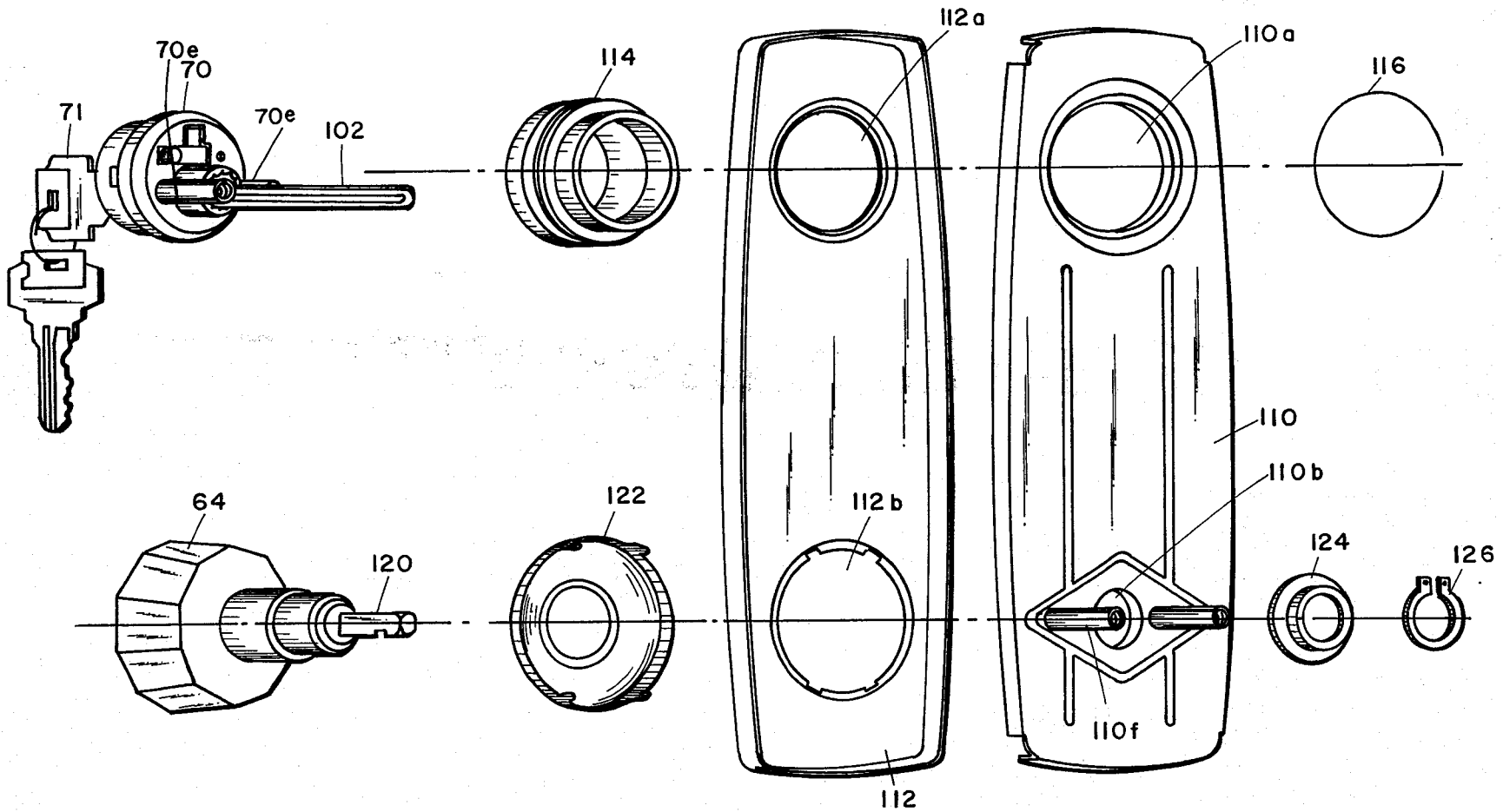
Figure 4B:
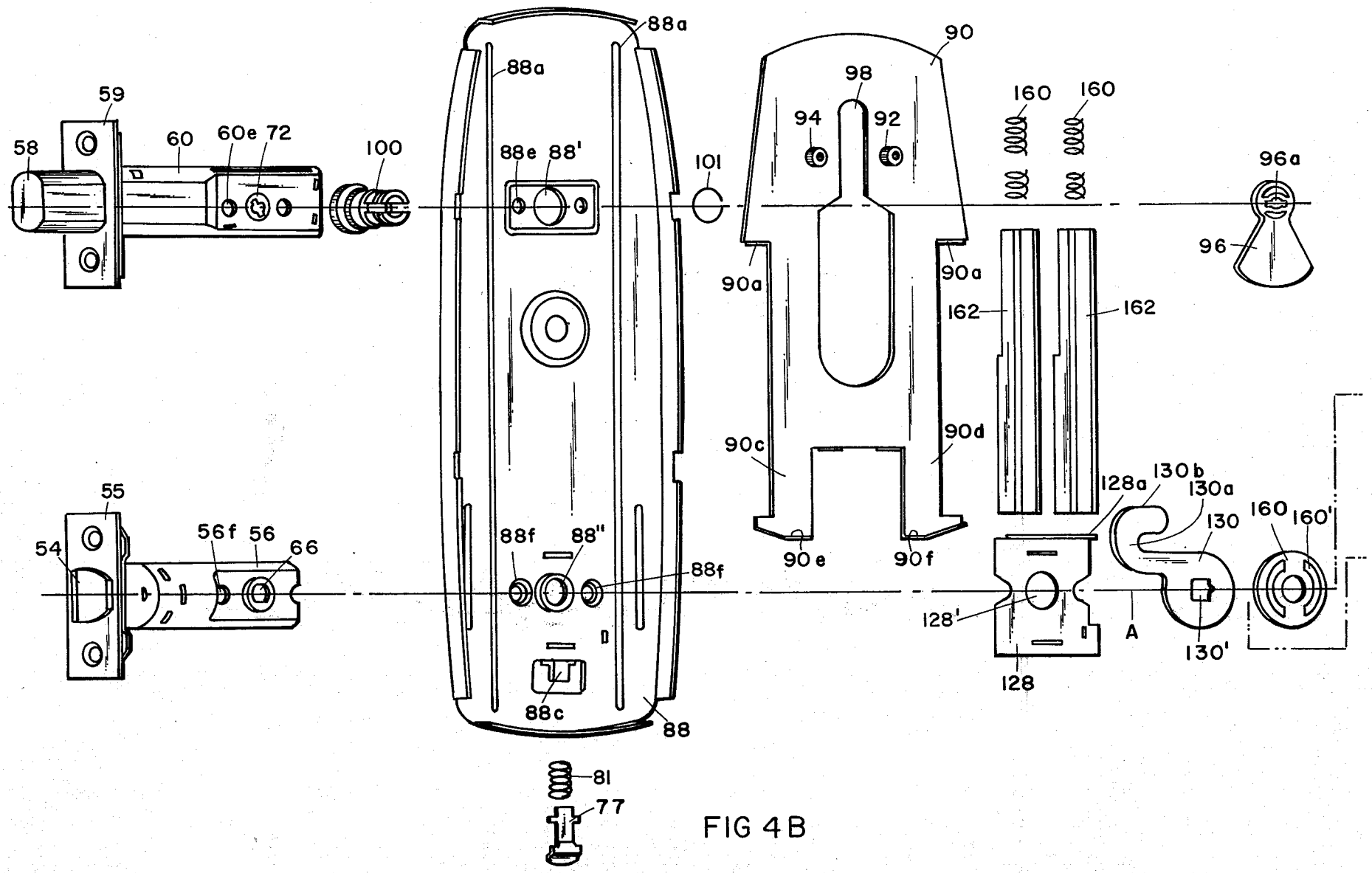

Lock 10 includes an inner subassembly 50 and an outer subassembly 52, adjacent the respective inside 12*a* of door panel 12 and outside 12*b* of door panel 12. Each subassembly has a framework based upon mounting plates, as explained hereinafter. Between the inner framework and the outer framework is a latch bolt subassembly 56 that includes a reciprocable latch bolt 54 and a latch bolt throw mechanism (FIG. 3 and FIG. 4B). Also between the inner and outer frameworks, i.e. between the inner and outer subassemblies, is a security dead bolt subassembly 60 including a reciprocable dead bolt 58 with its dead bolt throw mechanism. This latch bolt assembly is of a known type, for example as shown in U.S. Pat. No. 3,020,073 to M. E. Williams. The dead bolt subassembly is of a known type, for example as in U.S. Pat. No. 3,799,592 to J. H. Babb, Jr. and O. C. Maurits, the inventors herein. Both disclosures are incorporated by reference herein.

At the inside of the door is an inner hand operator 62, typically a knob as shown but alternatively a conventional lever or the like. Opposite this element and aligned therewith on axis A, is an outer hand operator 64 such as a knob as shown or a lever, on the outside of the door. These are aligned with the split swivel 66 of the latch mechanism and assembly 56 (FIG. 4B). Shown above inner knob 62 is an inner hand turn 68. A conventional key lock 70 having a tailpiece is mounted to the outside of the door in alignment with hand turn 68, both of these being in alignment with swivel 72 (FIG. 4B) of the security dead bolt assembly 60.

The inner framework of the lock includes a primary mount plate 88, an inner cover plate 74 (FIG. 4C), an escutcheon 76 and smaller components associated therewith. These components include a washer 78, a spring washer 80, a pair of retainer rings 82 and a nylon or other polymeric washer 84, all cooperative with the protruding nose 68' of the hand turn or thumb turn 68 which projects through opening 76' in the escutcheon. These plates are vertically elongated metallic members. Plate 88 has peripheral flange portions protruding toward cover plate 74. It also has a pair of elongated, spaced, parallel embossments 88*a* forming bearing surfaces for a vertically reciprocable slide 90. Escutcheon 76 is retained to the subassembly by retainer clips 77 and 79 (FIG. 4B and 4C) biased into position by springs 81 and 83, respectively. Spring 81 is held on finger 88*c*. Spring 83 is retained by element 74*c*.

Slide plate 90 has a unique character and function. It reciprocates vertically, being biased in one direction by springs. This slide plate has a pair of spaced bosses 92 and 94 projecting from the inside face of the plate, to serve as cam followers in cooperation with a driven pivotal pendulum cam 96 which they straddle, in a manner to be described hereinafter. Between these two followers is an elongated vertical slot 98 in the slide plate 90 where bearing 100 projects through the plate. The slot allows vertical plate movement without interference from the bearing. The lower portion of the slot is wider than the upper portion, as seen in FIG. 4B.

Bearing 100 supports the tailpiece driver 102 that extends from key lock 70. This tailpiece 102 thus extends through the matching opening in security dead bolt swivel 72, through bearing 100, through elongated vertical slot 98 of slide 90, through matching opening 96*a* in driven cam 96, and into a matching opening in turnpiece 68, all as shown in FIG. 3. Therefore, rotation of the cylinder lock and tailpiece 102 by a key 71 will rotate dead bolt swivel 72 to extend or retract dead bolt 58, depending upon the direction of rotation, and will also rotate cam 96 and turnpiece 68. Likewise, rotation of turnpiece 68 will rotate tailpiece 102 to rotate, i.e. pivot cam 96, and rotate dead bolt swivel 72. Tailpiece 102 in conventional fashion has a flat elongated configuration with a generally rectangular cross section, there being a corresponding cross section in the opening of swivel 72, and in opening 96*a* of cam 96 as well as the opening in turnpiece 68.

Cam 96 is spaced from cover plate 74 by an annular spacer 97. A wire retainer 101 secures bearing 100 in position, projecting through orifice 88' in mount plates 88. Thus, mount plate 88, cover plate 74, and escutcheon 76 are on the inside of the door panel. On the outside of the door panel is a second mount plate 110 which forms a primary component of the outer framework, and an outer escutcheon 112 coupled thereto. Lock 70 projects through a conventional security ring 114, both of which assemble into orifice 112*a* in the top portion of escutcheon 112, and orifice 110*a* in the top portion of outer mount plate 110, retained by an annular wire retainer 116 in conventional fashion.

Outer hand turn or knob 64 has a solid spindle 120 projecting inwardly therefrom, the axle of the knob projecting through trim collar 122 and opening 112*b* in the lower portion of escutcheon 112, as well as opening 110*b* in the lower portion of mount plate 110. On the inside face of mount plate 110 is a spacer washer 124 and a retainer ring 126 for the knob assembly. Spindle 120 projects into the correspondingly shaped opening in the outer part of conventional split swivel 66 of latch bolt assembly 56 such that rotation of the outer knob will rotate this part of the swivel and operate the latch bolt. This outer spindle 120 terminates part way through the swivel at the latch bolt mechanism. The components shown to the right of the latch bolt in the combined FIGS. 4A, 4B, 4C and 4D, and on the same axis A with the latch bolt swivel, are operated by the inner hand element or knob 62. Sleeve 62*a* of inner knob 62 projects through annular trim collar 140 (FIG. 4D) through opening 76'' in the lower portion of escutcheon 76 and through opening 74'' of cover plate 74. Knob sleeve 62*a* receives and is rotationally drivingly engaged with sleeve 142 of cam subassembly 144 (shown exploded in the central portion of FIG. 4C and shown assembled in the lower portion of FIG. 4C). Sleeve 142 includes a knob retainer 146, a spindle spring 148, a spindle washer 150 having a square opening therein receiving the elongated spindle shaft 152 square in cross section. The end of sleeve 142 away from the inner knob 62 has axially extending arcuate portions 142' which project into correspondingly shaped arcuate slots 154' of cam element 154. Also mounted on spindle 152 is a spacer 156 positioned, when assembled, within an opening 158' of sleeve base 158 adjacent sleeve washer 160. Washer 160, like cam member 154, includes a pair of arcuate slots 160' to receive the arcuate ends 142' of sleeve 142. Spindle 152 extends through a like configurated, i.e. square opening 130' in driver 130, through enlarged round opening 128' in sleeve base washer 128, through round opening 88'' in the lower portion of inner mount plate 88, and into the like configurated square opening of the inner part of split swivel 66 of latch bolt assembly 56. Thus, split swivel 66 has spindle 152 projecting thereinto from one side, and spindle 120 projecting thereinto from the opposite side. Rotation of any one of spindle 152, driver 130, and the inner part of swivel 66 will cause rotation of the other two.

Figure 4C:
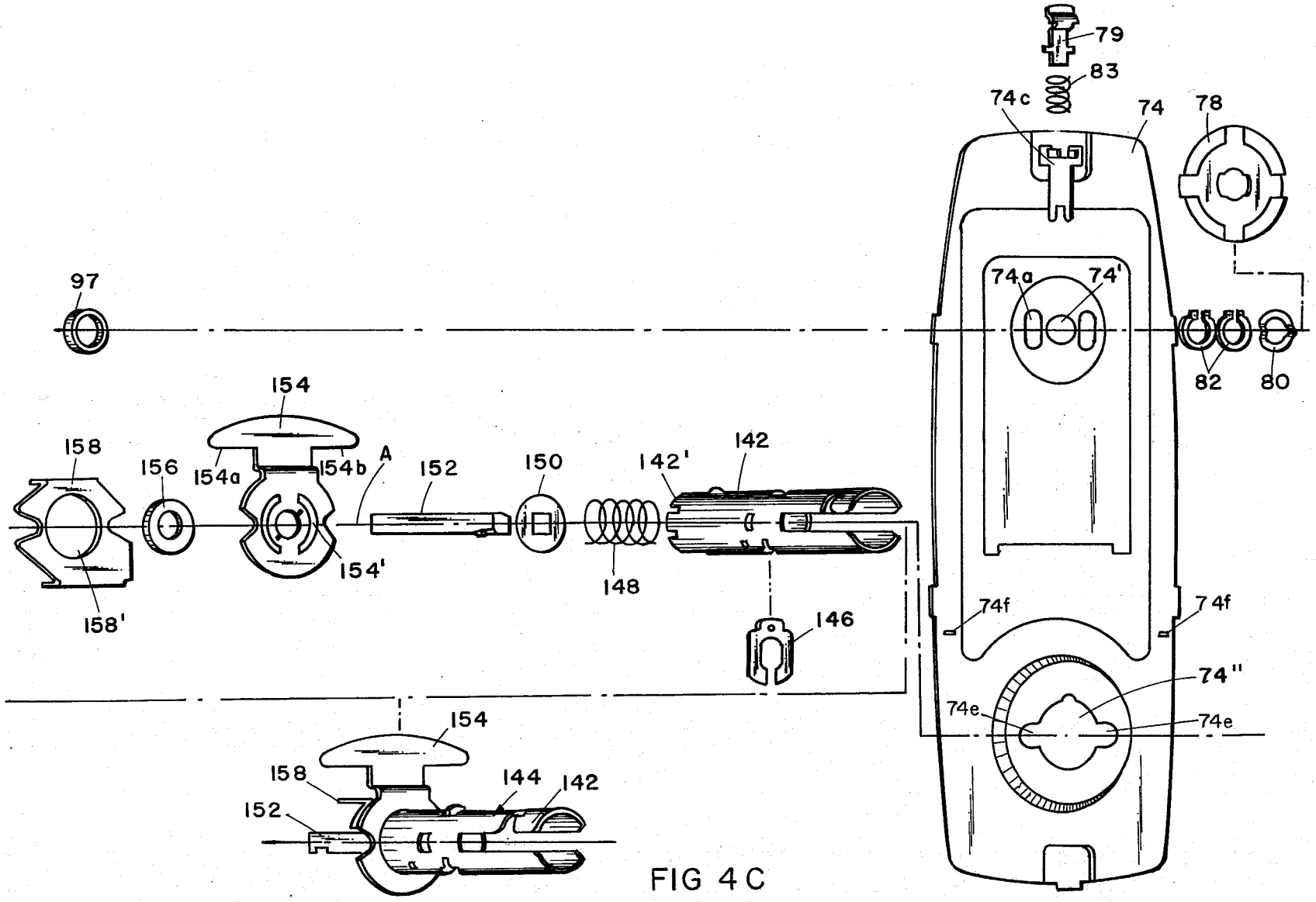

Vertical slide element 90 is a central component of the mechanism. It is mounted adjacent the inside face of the door panel between support plate 88 and cover plate 74. It includes a pair of laterally projecting, downwardly facing shoulders 90*a* on opposite sides thereof between the vertical ends of the plate. The upper ends of a pair of coil compression springs 160 (FIG. 4B) abut against these shoulders. These springs are retained in a pair of vertical spring guides 162, with the respective lower ends of the springs abutting against the closed lower ends of spring guides 162 which abut against stops 74*f* in cover plate 74 (FIG. 4C). Thus, the slide 90 is biased to an upward position, but can be lowered against the bias of springs 160 by actuation of special cam element 154. Specifically, rotation of driver cam element 154 about its axis A, which is also the axis of knobs 62 and 64, causes the pivotal rotational movement thereof in one direction or the other. Cam 154 has a pair of camming portions or ears radially offset from axis A. The lower surfaces 154*a* and 154*b* of the ears of this cam engage the upper surfaces of horizontal flanges 90*e* and 90*f* (FIG. 4B) respectively forming feet on the depending legs 90*c* and 90*d* respectively of slide 90. Thus, rotation of driver cam 154 in a clockwise direction (as viewed) will cause camming surface 154*b* to depress flange foot 90*f* downwardly to pull the entire slide 90 downwardly against the bias of springs 160. Likewise, rotation of cam 154 in a counterclockwise direction will cause surface 154*a* to engage and depress foot flange 90*e* to also cause the entire slide 90 to be depressed downwardly. This depression of slide 90 has a functional relationship with both the latch mechanism and the deadlock mechanism.

More specifically, the radially projecting protrusion 130*a* of driver 130, offset from the vertical, and specifically the upper surface 130*b* thereof (FIG. 4B) is in engagement with the undersurface of one of the foot flanges, specifically flange 90*e*, such that depression of slide 90 causes downward rotation of latch driver 130 about its axis A. This rotation causes rotation of inner spindle 152, which causes rotational activation of swivel 66 of latch subassembly 56. Thus, when the inner knob 62 is rotated, to rotate cam 154 and depress slide 90, the latch is retracted through the latch driver 130. However, when the latch is retracted by outer knob 64, latch driver 130 is not operated, and neither is slide 90. The drive motion from the outer knob is interrupted between the two parts of the split swivel 66 so as to have no effect upon the dead lock mechanism. I.e., operation of the slide will operate the latch driver, but operation of the latch driver will not operate the slide.

As noted previously, the dead lock bolt can be extended or retracted by key lock mechanism 70 or by turnpiece 68. It can also be retracted simultaneously with retraction of the latch bolt by the use of the inner knob 62. Specifically, this is done by cooperation of the slide with driven pendulum cam 96. This cam 96 is in a lowered neutral rotational position (FIG. 2), i.e. vertically down, when the dead lock bolt is in a retracted condition. It is in one of two possible elevated cocked positions (FIG. 1) when the dead lock is in the extended thrown position. The elevated position is about 120° in either direction from the lowered vertical position, one being shown in solid lines in FIG. 1, and the other being shown in phantom lines in FIG. 1. Whether the pendulum cam moves to one elevated position or the other in its cocked condition will depend upon whether the lock is mounted in a left-hand door arrangement or a right-hand door arrangement. In the embodiment depicted, employing a left-hand door arrangement, the cam is shown on the right-hand side in its elevated position, a position which it automatically assumes with turning of the turnpiece or the key lock. Lowering of the slide against the bias of compression springs 160 causes one of the cam follower bosses 92 or 94 to engage and depress the cam 96 to its lowered neutral condition where it remains until reset. This rotation of cam 96 causes it to serve as cam actuating means for rotation of tailpiece 102 and thus rotation of swivel 72 of the dead lock bolt subassembly to retract dead bolt 58 from the extended position in FIG. 1 to the retracted position in FIG. 2. This occurs with rotation of inner knob 62, such that the inner knob not only retracts the latch bolt, but also retracts the dead bolt.

When the lock assembly is mounted in a door, the typical four holes are drilled, i.e. an enlarged upper cylindrical hole 13 (FIG. 3) between the inside door face and the outside door face, the lower cylindrical hole 15 between the inside and outside faces of the door, and two vertically spaced cylindrical holes 17 and 19 (FIG. 2) extending between the edge of the door panel and holes 13 and 15. Holes 17 and 19 receive the cylindrical housings of security dead lock bolt assembly 60 and latch bolt assembly 56, respectively. The latch bolt plate 55 is attached to the edge of the door in conventional fashion as by screws. The dead bolt plate 59 is attached to the edge of the door in conventional fashion as by screws. These two assemblies 56 and 60 are mounted first in the door in usual fashion, and then the two subassemblies of the remainder of the lock combination are attached to the front face and the back face of the door, interfitting with the latch and dead bolt subassemblies. The components of the outer subassembly 52 are assembled with each other at the factory. Also, the inner subassembly 50 components are assembled at the factory, except for inner escutcheon plate 76, turnpiece 68 and inner knob 62. At installation, outer subassembly 52 is placed against the outer door face 12*b*, with tailpiece 102 being inserted through the dead lock swivel and cam 96, and spindle 120 being projected into the latch swivel 66. These several components are shown in exploded form in FIGS. 4A–4D for clarity. For a full view thereof, the centerlines of the rotation axes should be aligned with FIG. 4A on the left, FIG. 4B to its right, FIG. 4C to its right and FIG. 4D to its right.

Then, the inner assembly 50, except for turn 68, knob 62 and escutcheon 76 is placed against the interface 12*a* of the door panel in alignment with the outer subassembly and a pair of screws (not shown) are extended through openings 74*a* in plate 74, through the enlarged lower portion of slot 98 in slide 90, through openings 88*e* in mount plate 88, through openings 60*e* in dead bolt assembly 60, and into threaded engagement with openings 70*e* in lock 70. A second pair of screws is extended through cut out openings 74*e* (FIG. 4C), through openings 88*f* in plate 88 on the lower portion thereof, through openings 56*f* in latch assembly 56, and into threaded engagement with the tie rods 110*f* projecting inwardly from their integral connection to plate 110. Next, escutcheon plate 76 is snapped into place over the escutcheon retainers 77 (FIG. 4B) and 79 (FIG. 4C), these retainers snapping into engagement with the escutcheon plate under the bias of respective springs 81 and 83. Turn 68, having been assembled onto plate 76 previously, is slid into position over the exposed end of tailpiece 102 when the plate is snapped into place. Knob 62 is snapped into place on the end of sleeve 142. The unit is then ready for functioning. The functioning of the apparatus is as follows.

Figure 2:
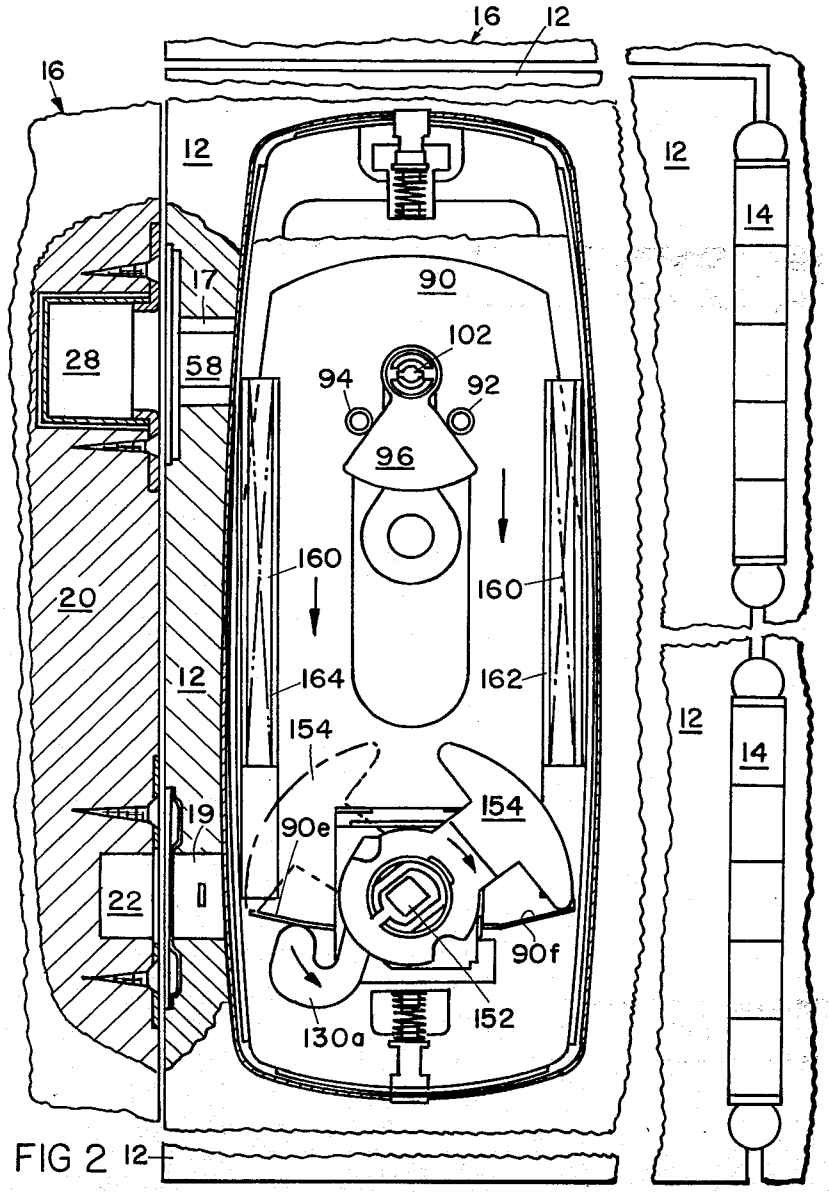
FIG. 2 is an elevational view of the lock assembly in FIG. 1, partially in section, with the dead bolt and latch bolt in retracted positions.

Firstly, to lock the upper security dead bolt, rotate thumb turn 68 or key 71 toward the latch side of the door. Both will rotate tailpiece 102, which in turn rotates swivel 72, pushing security dead bolt 58 into the extended locked position (FIG. 1). The tailpiece 102 also rotates driven cam 96 up into position against either cam follower 92 or cam follower 94, depending upon whether the lock combination is mounted in a left-hand or right-hand door arrangement. Key 71 can be removed by returning it to the start position in conventional fashion. Thumb turn 68 remains in the horizontal position as an indicator that the door is locked.

To unlock the upper dead bolt with the thumb turn or key, the thumb turn 68 or key 71 is rotated toward the hinge side of the door. Either will rotate tailpiece 102, which rotates swivel 72, pulling bolt 58 back to the retracted, unlocked position. Tailpiece 102 also rotates cam 96 down away from the cam follower bosses 92 or 94, restoring it to the neutral lower position on slide 90. Key 71 can be removed by returning it to the start position. Thumb turn 68 remains in the vertical position as an indicator that the door is unlocked.

To retract the lower latch bolt with the inside knob, the knob 62 is rotated in either direction. Knob 62 rotates knob sleeve 142, which rotates double-acting slide depresser cam 154, pushing down on either foot 90*e* or 90*f* on slide 90. Abutment shoulders 90*a* on slide 90 compress coil springs 160. Foot 90*e* on slide 90 pushes down against cam follower surface 130*b* on rotary latch driver 130. Latch driver 130 rotates latch spindle 152, which in turn rotates latch swivel 66. Swivel 66 in latch 56 pulls back the latch bolt 54 against the bias of its internal spring of conventional type (not shown). When knob 62 is released, springs 160 expand, pushing upwardly against shoulders 90*a* on slide 90, restoring slide 90 upwardly to its up position. Legs 90*c* or 90*d*, with feet 90*e* or 90*f* respectively, restore slide depresser cam 154 to the neutral position. The spring (not shown) in latch 56 pushes latch bolt 54 outwardly, rotating swivel 66. Swivel 66 rotates spindle 152, which rotates latch driver 130 upwardly, positioning surface 130*b* against foot 90*e* on slide 90. Cam 154 rotates sleeve 142 which rotates knob 62 to its original position.

To retract the lower latch bolt with the outside knob, knob 64 is rotated in either direction. Knob 64 rotates spindle 120 which rotates latch swivel 66. Swivel 66 in latch 56 pulls back latch bolt 54. When knob 64 is released, a spring (not shown) in latch 56 pushes latch bolt 54 outwardly, rotating swivel 66. Swivel 66 rotates spindle 120, restoring knob 64 to its original position.

To both unlock the dead bolt and retract the latch with the inside knob, the knob 62 is rotated in either direction. Knob 62 rotates knob sleeve 142, which rotates cam 154, pushing down on either foot 90*e* or 90*f* on slide 90. Shoulders 90*a* on slide 90 compress coil springs 160. Either cam follower 92 or 94 on slide 90 pushes down on cam 96, rotating it to the neutral position from its upper cocked position. Cam 96 serves as an actuating means to rotate tailpiece 102, which rotates swivel 72 in latch 60. Swivel 72 pulls latch bolt 58 back to the unlocked position. Tailpiece 102 also rotates thumb turn 68, positioning it in the vertical position, indicating the door is unlocked. Foot 90*e* on slide 90 pushes down against surface 130*b* on latch driver 130. Latch driver 130 rotates spindle 152, which rotates latch swivel 66 in latch 56. Swivel 66 pulls back latch bolt 54. When knob 62 is released, springs 160 expand, pushing upwardly against shoulders 90*a* on slide 90, restoring the slide to its up position. Foot 90*e* or 90*f* restores driver cam 154 to the neutral position. A spring in latch 56 pushes latch bolt 54 outwardly, rotating swivel 66. Swivel 66 rotates spindle 152, which rotates latch driver 130 upwardly, positioning surface 130*b* against foot 90*e* on slide 90. Cam 154 rotates sleeve 142 which rotates knob 62 to its original position.

Those in this art will readily note the relative simplicity of the assembly and components. Manufacture and assembly of the components constitutes a significant advantage, especially in view of the features resulting. The capacity of assembly on either left or right-hand door arrangements without the necessity of handing is believed totally unique. The lock is not dependent upon any laterally sliding elements but functions through the vertical slide which has the same motion on both types of door arrangements. The security dead bolt mechanism is protected against tampering from the outside, since the vertical slide serving as the activating element from the inner knob to the dead bolt is totally on the inside of the door, basically inaccessible from the outside even if the outer knob is smashed off the spindle and latch mechanism.

Tortuous and high multiple performance testing of the lock has demonstrated its long life capacity with continued dependable operation.

Conceivably, the details of the specific preferred embodiment set forth as illustrative could be modified to suit a particular style or to add further features which may be desired. For example, a key cylinder could be incorporated in the outer hand operator knob. Or, the dead bolt mechanism could be placed below the latch mechanism instead of above it. The slide plate could be biased down and forcefully raised instead by vice versa, by vertically inverting the cam and cam followers.

Therefore, it is intended that the invention should not be limited to the details of the illustrative embodiment set forth.

The embodiments of an invention in which an exclusive property or privilege is claimed are defined as follows.

1. A lock for a door comprising:

support structure including inner framework for mounting inside the door and outer framework for mounting outside the door;

a latch bolt mounted on said support structure between said inner and outer frameworks for reciprocation between extended and retracted positions and means biasing said latch bolt to said extended position;

a security dead bolt mounted on said support structure between said inner and outer frameworks, spaced vertically from said latch bolt for reciprocation between extended and retracted positions;

first mechanical means mounted between said frameworks for reciprocating said latch bolt from said extended position to said retracted position;

second mechanical means mounted between said frameworks for reciprocating said security dead bolt between said extended and retracted positions;

an outer hand operator on said outer framework connected to said first mechanical means for shifting said latch bolt to the retracted position;

an inner hand operator on said inner framework;

an inner turnpiece on said inner framework for operating said second mechanical means;

a vertically shiftable slide on said inner framework;

a driver cam at said inner framework connected to said inner hand operator to be operated thereby, and in engagement with said slide to vertically shift said slide when operated by said inner hand operator;

a one way drive latch driver connected to said first mechanical means and engaged by said slide to transfer force from the shifted slide to said first mechanical means to retract said latch bolt;

and a driven cam at said inner framework, shiftable between a cocked condition and a neutral condition, connected to said second mechanical means, and operably engaged with said slide to be shifted thereby, to retract said security dead bolt when shifted from said cocked condition to said neutral condition with vertical shifting of said slide.

2. The lock in claim 1 wherein:

said driven cam being shiftable from either of two cocked positions, in said cocked condition, to said neutral condition, for accommodating said lock bolt in either left or right-hand orientation.

3. The lock in claim 1 wherein:

said driver cam is rotational in either direction, and has a pair of alternate surfaces engaging said slide such that rotation in either direction causes vertical shifting of said slide in the same direction, for actuation of said inner hand operator in alternate directions.

4. The lock in claim 1 wherein:

said driver cam is rotational in either direction, and has a pair of alternate surfaces engaging said slide such that rotation in either direction causes vertical shifting of said slide in the same direction, for actuation of said inner hand operator in alternate directions, and said driven cam being shiftable from either of two cocked positions, in said cocked condition, to said neutral condition, for accommodating said lock bolt in either left or right-hand orientation.

5. A lock for a door comprising:

support structure including inner framework for mounting inside the door and outer framework for mounting outside the door;

a latch bolt mounted on said support structure between said inner and outer frameworks for reciprocation between extended and retracted positions and means biasing said latch bolt to said extended position;

a security dead bolt mounted on said support structure between said inner and outer frameworks, spaced vertically from said latch bolt for reciprocation between extended and retracted positions;

first mechanical means mounted between said frameworks for reciprocating said latch bolt from said extended position to said retracted position;

second mechanical means mounted between said frameworks for reciprocating said security dead bolt between said extended and retracted positions;

an outer hand operator on said outer framework connected only to said first mechanical means for shifting said latch bolt to the retracted position;

an inner hand operator on said inner framework;

a vertically shiftable slide on said inner framework;

a driver cam at said inner framework connected to said inner hand operator to be operated thereby, and in engagement with said slide to vertically shift said slide when operated by said inner hand operator;

a one way drive latch driver connected to said first mechanical means and engaged by said slide to transfer force from the shifted slide to said first mechanical means to retract said latch bolt;

and a driven cam at said inner framework; shiftable between a cocked condition and a neutral condition, connected to said second mechanical means and operably engaged with said slide to be shifted thereby, to retract said security dead bolt when shifted from said cocked condition to said neutral condition with vertical shifting of said slide;

said second mechanical means, said slide, said driver cam, said driven cam, said security dead bolt and said inner hand operator being nonoperable by said outer hand operator.

6. The lock in claim 5 wherein said driven cam is a pivotal cam shiftable from either of two cocked positions, in said cocked condition, to said neutral condition, for accommodating a left-hand or a right-hand door installation, and said slide includes a pair of cam followers generally astraddle of said pivotal cam, one of said cam followers being operably associated with said pivotal cam when in one of its cocked positions, and the other of said cam followers being operably associated with said pivotal cam when in the other of its cocked positions.

* * * * *